US010658132B2

(12) United States Patent
Bianco et al.

(10) Patent No.: US 10,658,132 B2
(45) Date of Patent: May 19, 2020

(54) SWITCHING DEVICE

(71) Applicant: ABB Schweiz AG, Baden (CH)

(72) Inventors: Andrea Bianco, Sesto San Giovanni (IT); Roberto Penzo, Milan (IT); Carlo Boffelli, Dalmine (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/566,080

(22) Filed: Sep. 10, 2019

(65) Prior Publication Data

US 2020/0083000 A1 Mar. 12, 2020

(30) Foreign Application Priority Data

Sep. 11, 2018 (EP) ..... 18193829

(51) Int. Cl.
*H01H 9/02* (2006.01)
*H01H 1/36* (2006.01)
(Continued)

(52) U.S. Cl.
CPC ..... *H01H 9/0271* (2013.01); *H01H 1/36* (2013.01); *H01H 9/30* (2013.01); *H01H 9/54* (2013.01)

(58) Field of Classification Search
CPC ..... H01H 9/0271; H01H 1/36; H01H 9/30; H01H 9/54
See application file for complete search history.

(56) References Cited

U.S. PATENT DOCUMENTS 4,096,366 A * 6/1978 Titus ..... H02H 3/083 218/122
4,336,520 A * 6/1982 Trayer ..... H01H 33/666 337/191
2014/0078622 A1* 3/2014 Crane ..... H02H 3/087 361/8

FOREIGN PATENT DOCUMENTS

DE 10064525 A1 6/2002
EP 2523203 A1 11/2012
(Continued)

OTHER PUBLICATIONS

Wikipedia contributors. (Jan. 12, 2020). Series and parallel circuits. In Wikipedia, The Free Encyclopedia. Retrieved 20:46, Jan. 16, 2020, from https://en.wikipedia.org/w/index.php?title=Series_and_parallel_circuits&oldid=935472621 (Year: 2020).*
(Continued)

*Primary Examiner* — Daniel J Cavallari
(74) *Attorney, Agent, or Firm* — Taft Stettinius & Hollister LLP; J. Bruce Schelkopf

(57) ABSTRACT

A switching device for low or medium voltage electric power distribution networks, the switching device including one or more electric poles and, for each electric pole: an insulating housing defining an internal volume of said electric pole; a first pole terminal and a second pole terminal electrically connectable with a corresponding electric phase conductor of an electric source and with a corresponding electric phase conductor of an electric load, respectively; a movable contact and a fixed contact, which are coupleable/decoupleable one to another, the fixed contact being electric connected with the first pole terminal, the movable contact being electrically connected with the second pole terminal; a stack of semiconductor devices adapted to switch in conduction state or in an interdiction state depending on the voltage provided thereto.

20 Claims, 12 Drawing Sheets

Figure 1:
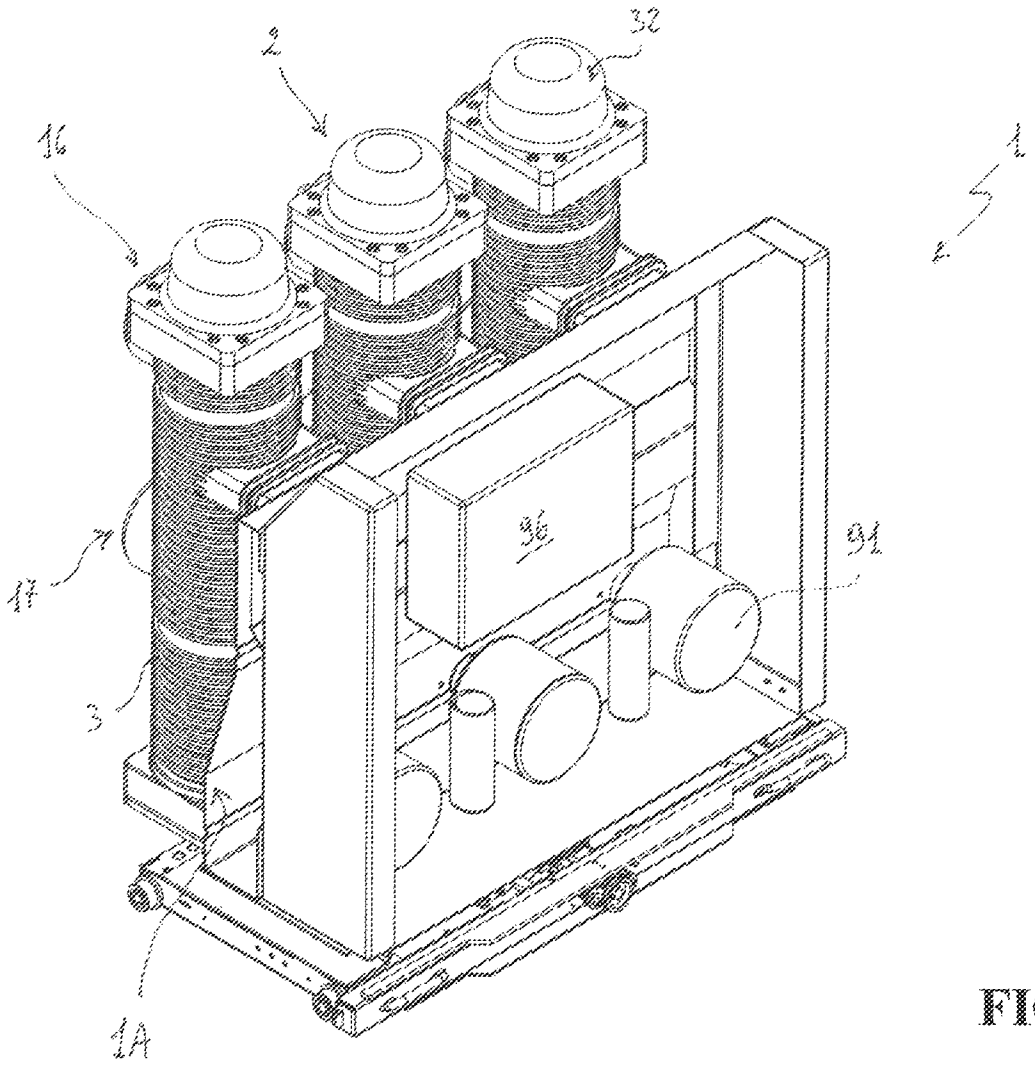

(51) Int. Cl.
*H01H 9/30* (2006.01)
*H01H 9/54* (2006.01)

(56) References Cited

FOREIGN PATENT DOCUMENTS

| | | | |
|---|---|---|---|
| EP | 2904626 | B1 | 9/2016 |
| WO | 2017005474 | A1 | 1/2017 |

OTHER PUBLICATIONS

European Patent Office, Extended Search Report issued in corresponding Application No. 18193829.1, dated Feb. 20, 2019, 10 pp.

* cited by examiner

SWITCHING DEVICE

The present invention relates to the field of switchgears for low or medium voltage electric power distribution networks.

More particularly, the present invention relates to an improved switching device for low or medium voltage electric power distribution networks.

In a further aspect, the present invention relates to a switchgear including the aforesaid switching device.

Within the framework of the present invention, the term "low voltage" (LV) relates to nominal operating voltages lower than 1 kV AC and 1.5 kV DC whereas the term "medium voltage" (MV) relates to nominal operating voltages higher than 1 kV AC and 1.5 kV DC up to some tens of kV, e.g. up to 72 kV AC and 100 kV DC.

As is known, switching devices are installed in electric power distribution networks for connecting/disconnecting an electric power source (e.g. a power line) with or from one or more associated electrical loads.

More traditional switching devices comprise one or more electric poles, each having a movable contact movable between a first operating position, in which it is coupled to a corresponding fixed contact, and a second operating position, in which it is decoupled from the fixed contact.

Each electric pole is electrically connected to an electric power line and the associated electrical loads, in such a way that a current can flow between the power line and the electric loads through a main conduction path provided by the coupled fixed and movable contacts.

On the other hand, the current flowing towards the electric loads is interrupted when the movable contacts are decoupled from the corresponding fixed contacts, for example in case of faults.

In some switching devices of the state of the art (such those disclosed in patent document EP2523203 and WO2017/005474A1), each electric pole is provided with a number of semiconductor devices (typically power diodes) configured to allow the passage of currents flowing according to a predetermined direction only.

Such semiconductor devices are electrically connected in series to each other and are arranged to allow or block the passage of currents flowing along an auxiliary conduction path, which is electrically connected in parallel with said main conduction path.

As is known, in these switching devices, a suitable synchronization of the movements of the movable contacts with the waveforms of the electric line voltage and of the load current allows reducing remarkable parasitic phenomena during operation, such as the generation of electrical arcs during opening manoeuvres (when the electric power line is disconnected from an electric load, e.g. a bank of capacitors). On the other hand, such a synchronization allows limiting possible inrush currents and transient overvoltages generated during closing manoeuvres (when the electric line electrically couples with the electric load).

Unfortunately, switching devices of the above-mentioned type have some critical aspects.

In order to limit the size of the electric poles, power diodes with small size, which cannot withstand operating voltages above a given threshold value (typically about 1 kV for standard devices) are normally adopted.

As the nominal operating voltages in the electric poles may reach some tens of kV, a large number of power diodes have to be employed.

However, this may make difficult the synchronization of the movements of the movable contacts with the waveforms of the electrical quantities related to the electric poles, in particular during the opening manoeuvres of the switching device.

As is known, such a difficult synchronization may lead to the formation of micro-arcs between the electric contacts, which have been proven to remarkably reduce the operating life of the electric contacts.

Additionally, these switching devices cannot normally withstand high current levels, e.g. in the order of tends of kA. As is obvious, this fact remarkably limits their use in electric power distribution networks, as they cannot provide short-circuit switching capabilities.

The main aim of the present invention is to provide a switching device for LV or MV electric power distribution networks that allows overcoming the drawbacks of the known art.

Within this aim, a purpose of the present invention is to provide a switching device showing improved performances in terms of reduction of parasitic phenomena during the opening/closing manoeuvres.

A further purpose of the present invention is to provide a switching device showing improved switching performances, even when short-circuit currents are present.

A further purpose of the present invention is to provide a switching device having electric poles with a compact and robust structure.

A further purpose of the present invention is to provide a switching device relatively simple and cheap to be manufactured at industrial levels.

The above aim and purposes, as well as other purposes that will emerge clearly from the following description and attached drawings, are provided according to the invention by a switching device for LV or MV electric power distribution networks, according to the following claim 1 and the related dependent claims.

In a further aspect, the present invention provides a switchgear for LV or MV installations, according to the following claim 11.

Figure 2:
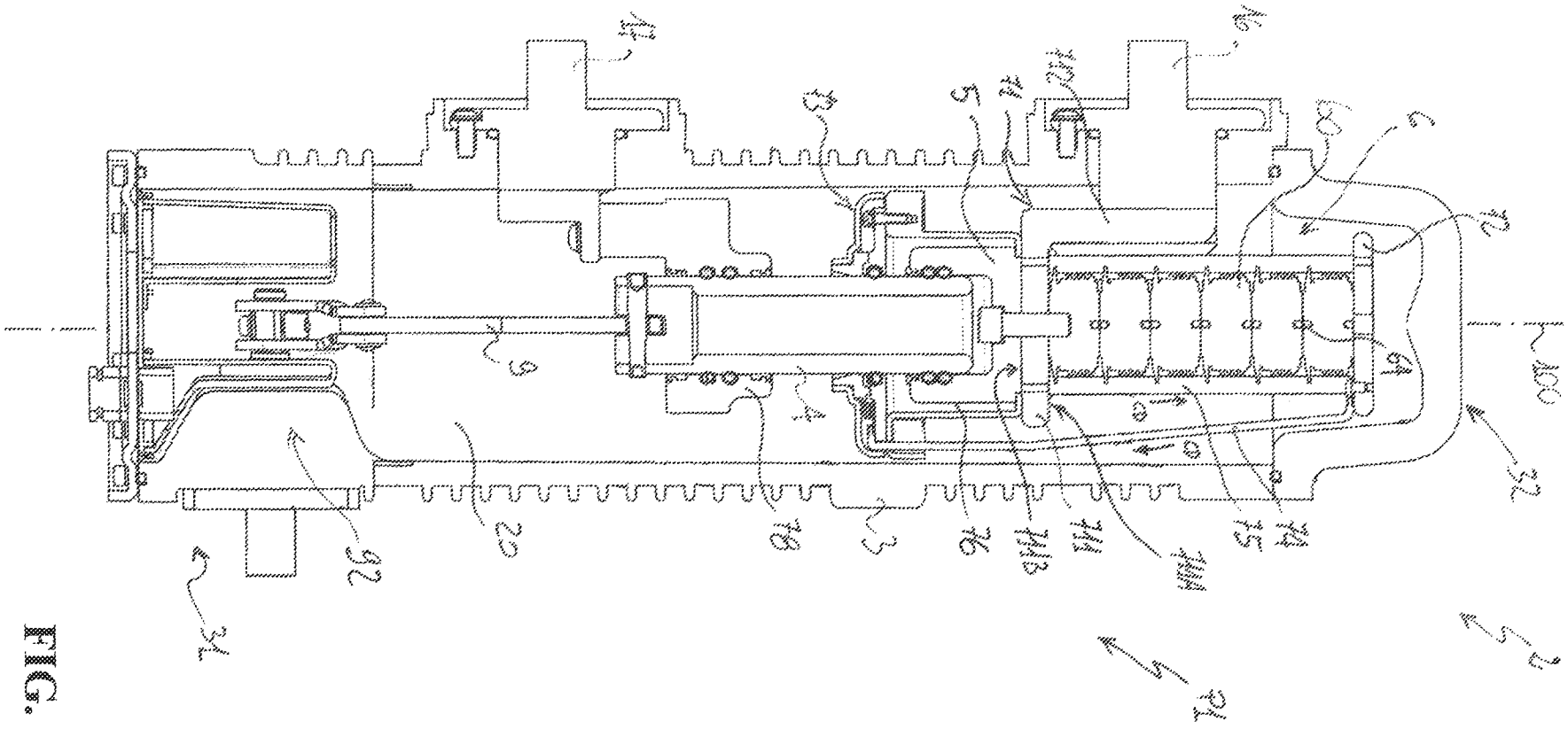
Figure 3:
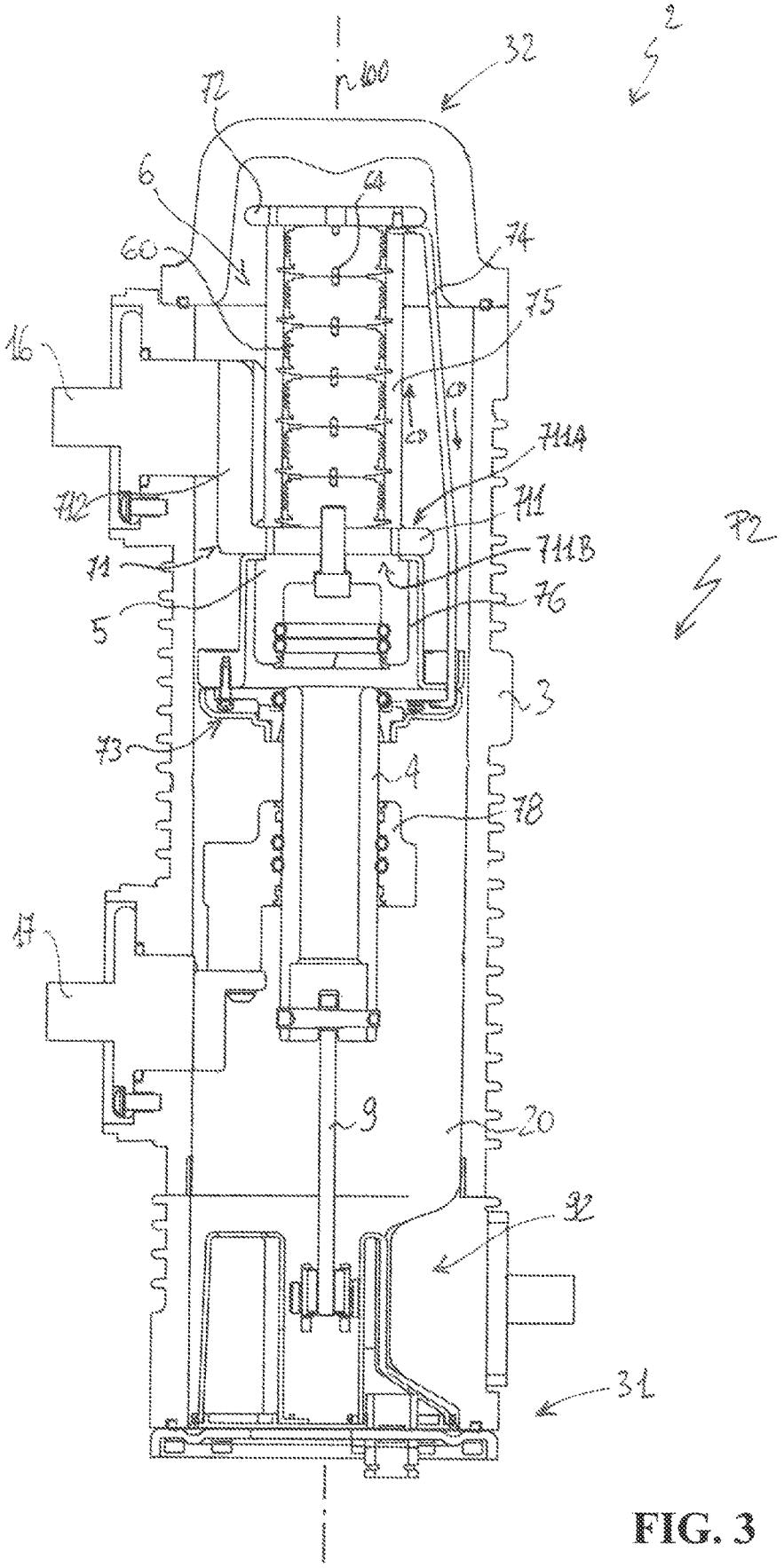
Figure 4:
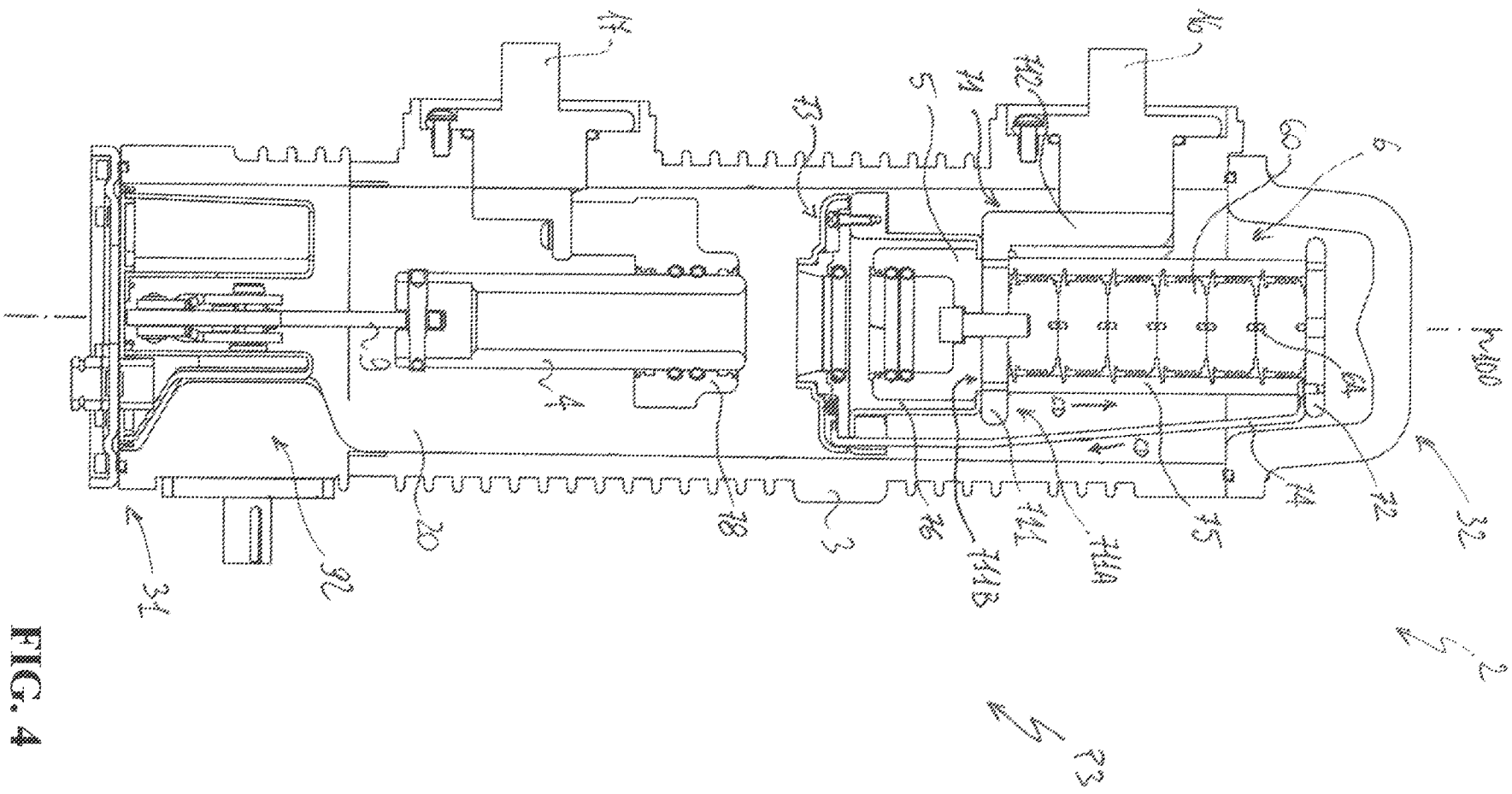
Figure 5:
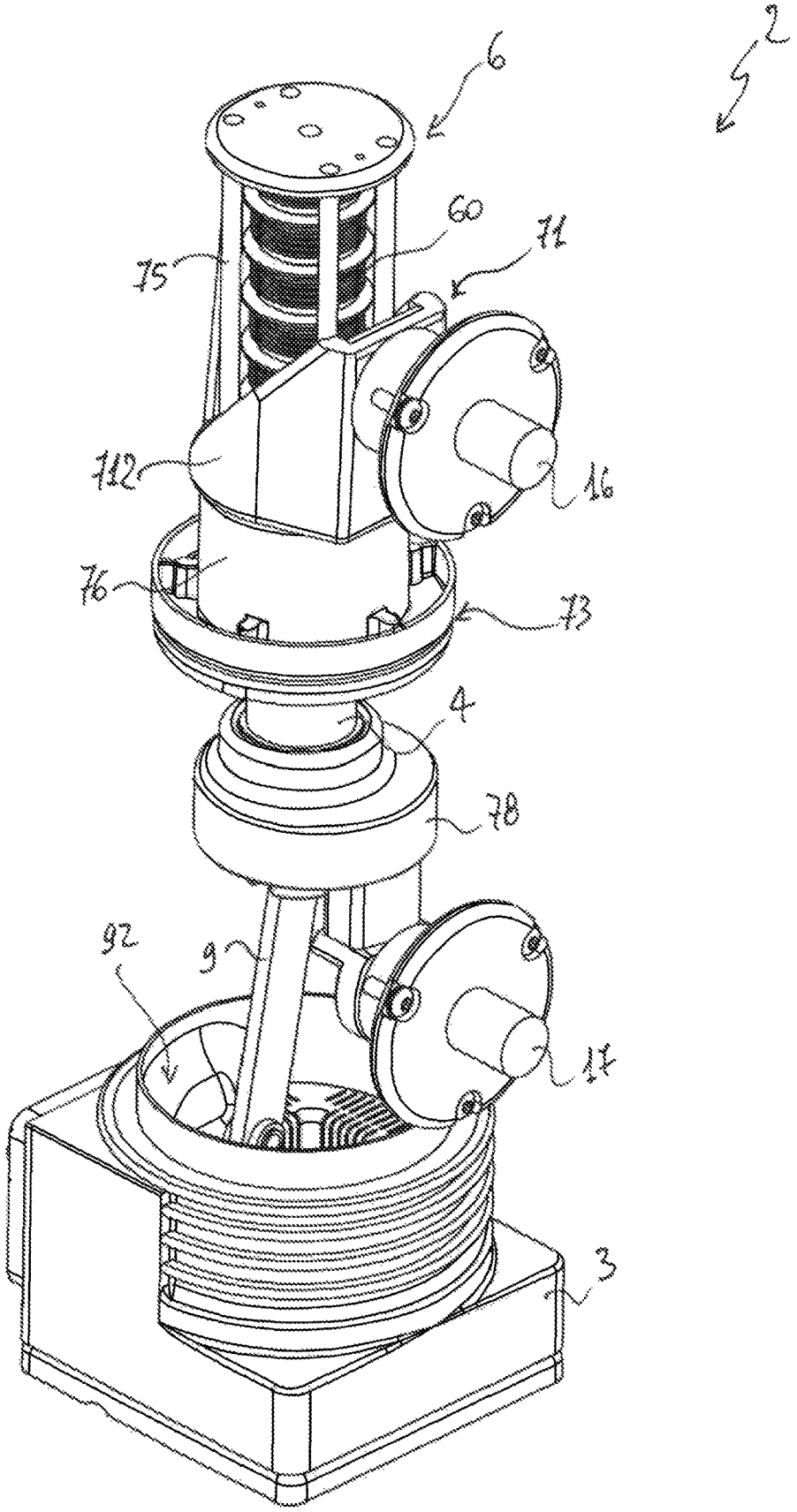
Figure 6:
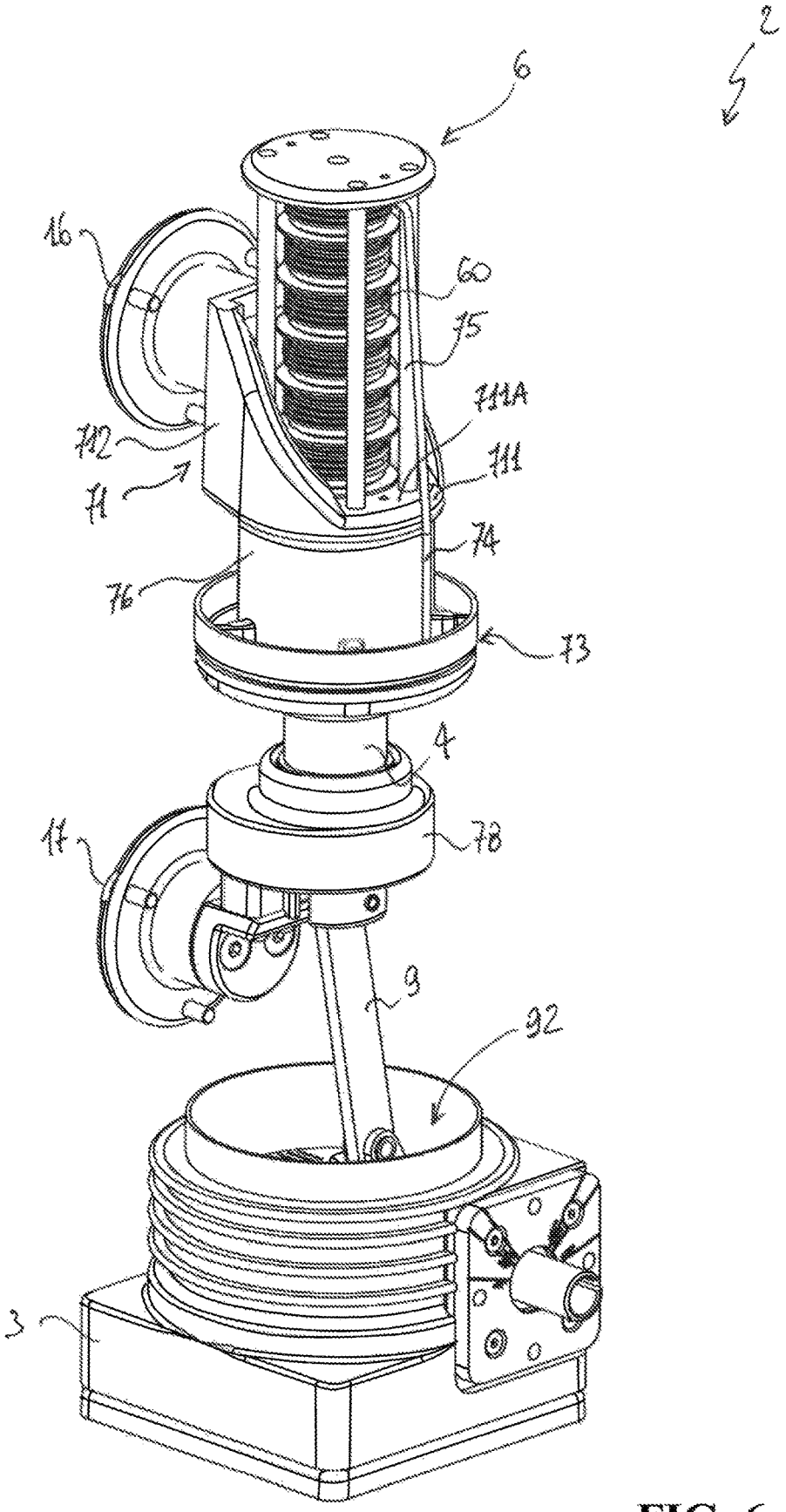
Figure 7:
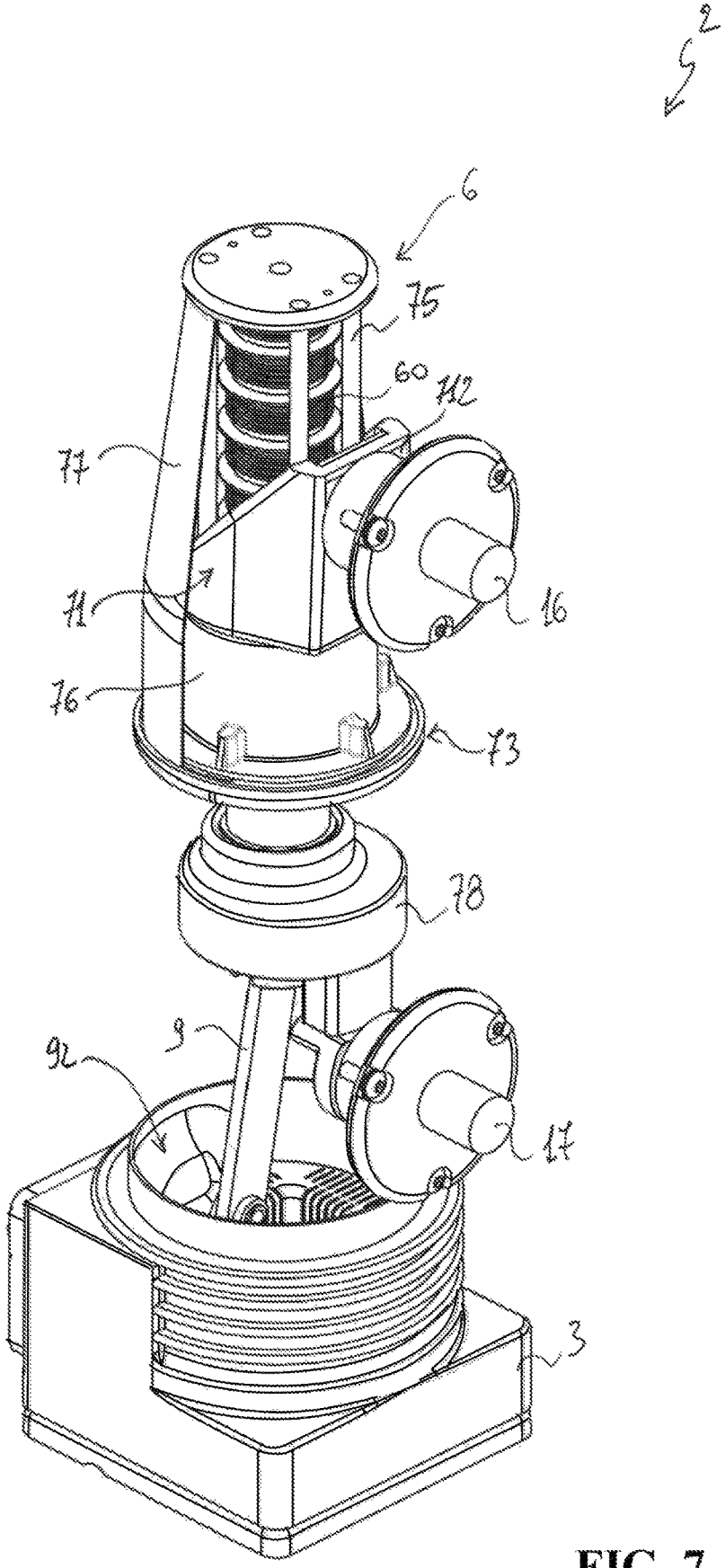
Figure 8:
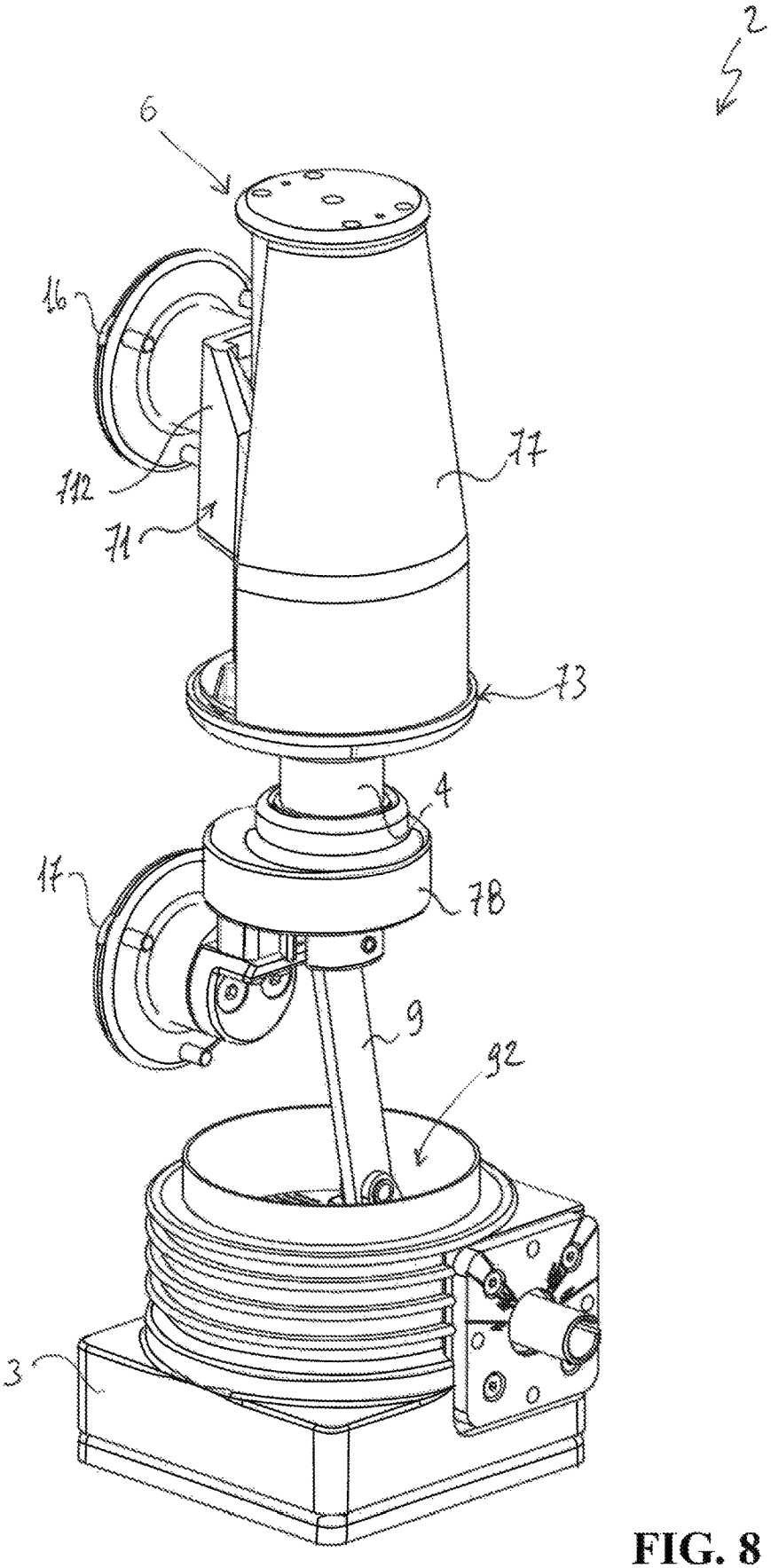

Characteristics and advantages of the present invention will become more apparent from the detailed description of preferred embodiments illustrated only by way of non-limitative example in the accompanying drawings, in which:

FIG. 1 schematically shows the switching device, according to the invention;

FIGS. 2-4 schematically show section views of an electric pole of the switching device, according to an embodiment of the invention, in different operating conditions;

FIGS. 5-6 schematically show cutaway views the electric pole shown the embodiment of FIGS. 2-4;

FIGS. 7-8 schematically show cutaway views an electric pole of the switching device, according to a further embodiment of the invention;

FIGS. 9-12 schematically show operation of electric poles of the switching device, according to the invention.

Referring to the cited figures, the present invention relates to a switching device 1.

The switching device 1 is particularly adapted for use in MV electric power distribution networks and it will be described hereinafter with reference to such specific application. However, the switching device 1 may be conveniently used also in LV electric power distribution networks.

Figure 9:
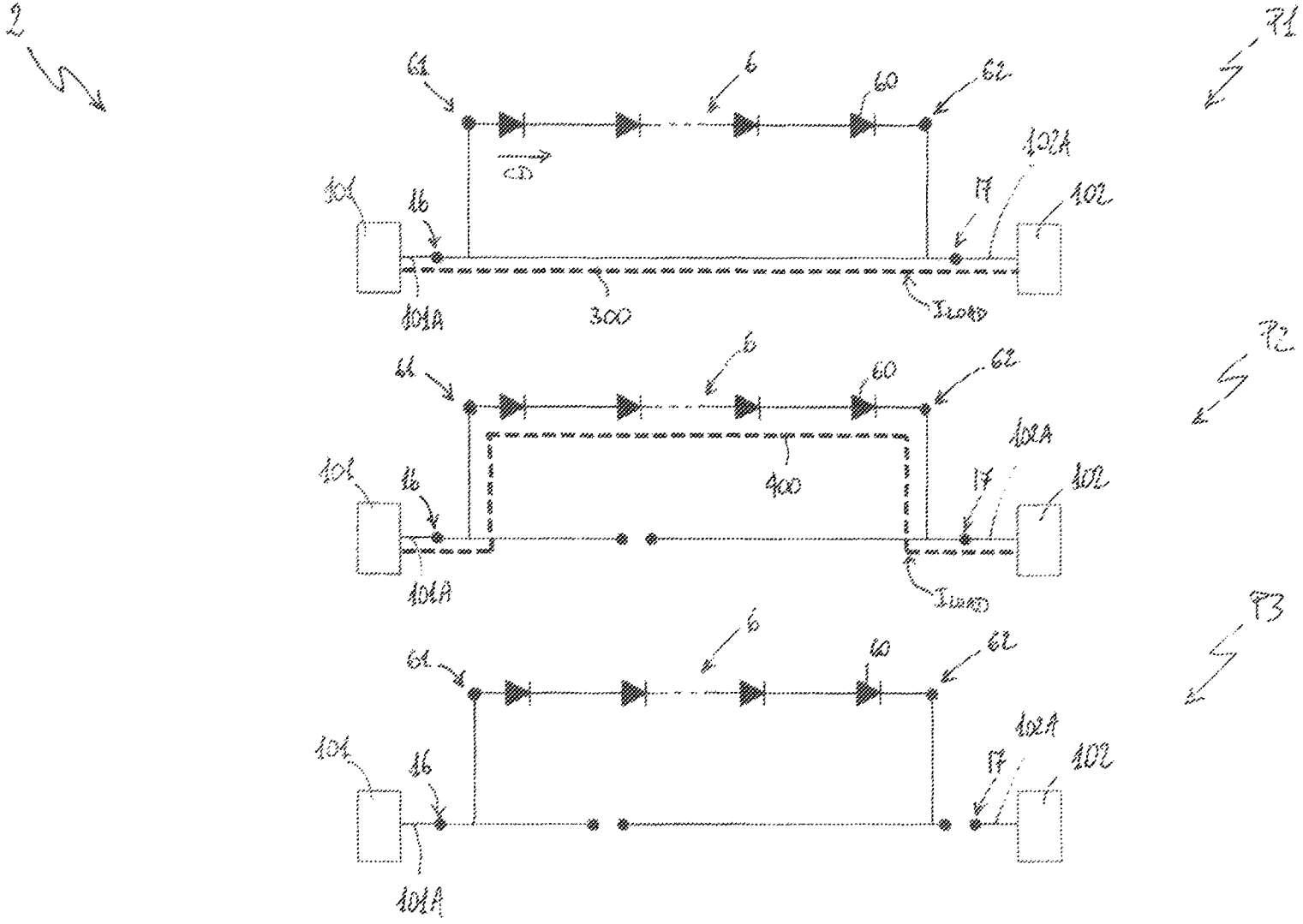

The switching device 1 is adapted to electrically connect or disconnect an electric power source 101 (e.g. a power line) with or from one or more associated electric loads 102 (FIG. 9).

The switching device 1 is particularly adapted to feed capacitive loads and it will be described hereinafter with reference to such specific application. In principle, however, the electric loads 102 may be of any type, according to the needs.

The switching device 1 comprises one or more electric poles 2 (for example three as shown in FIG. 1).

Each electric pole 2 is electrically connected to a corresponding phase conductor 101A of the electric power source 101 and to a corresponding load conductor 102A of an associated electrical load 102 (FIG. 9).

Each electric pole 2 comprises an insulating housing 3 defining an internal volume 20 in which a number of components of said electric pole are accommodated.

The housing 3 extends along a longitudinal axis 100, preferably with a cylinder-like shape, and has a bottom end 31, at which it is fixed to a main support structure 1A of the switching device 1, and a top end 32, opposite to the bottom end 31 and distally positioned with respect to the main support structure 1A.

Conveniently, the housing 3 is made of an electrically insulating material, which may be of known type.

Each electric pole 2 comprises a first pole terminal 16 and a second pole terminal 17.

The first pole terminal 16 is electrically connectable with a corresponding phase conductor 101A of the electric power source 101 while the second pole terminal is electrically connectable with a corresponding load conductor 102A of the electric load 102 (FIG. 9).

Each electric pole 2 comprises a movable contact 4 and a fixed contact 5, which are electrically connected with the first pole terminal 16 and the second pole terminal 17, respectively.

The movable contact 4 and the fixed contact 5 can be mutually coupled or decoupled. In particular, the moving contact 4 is adapted to (mechanically and electrically) couple with or decouple from the fixed contact 5 during a switching manoeuvre of the switching device 1.

During a closing manoeuvre of the switching device 1, the movable contact 4 moves towards the fixed contact 5 to couple with this latter to establish an electrical continuity between the pole terminals 16, 17 along a main conduction path 300 (FIG. 9).

During an opening manoeuvre of the switching device 1, the movable contact 4 moves away from the fixed contact 5 to decouple from this latter to interrupt the electrical continuity between the pole terminals 16, 17 along the main conduction path 300.

Preferably, the movable contact 4 moves linearly along the longitudinal axis 100 of the electric pole 2.

Preferably, the movable contact 4 is formed by a conductive rod (e.g. having a cylinder-like shape) arranged along the longitudinal axis 100 and supported by an actuating rod 9 made of electrically insulating material.

Preferably, the fixed contact 5 is formed by a conductive body (e.g. having a bush-like shape) defining a blind cavity open towards the movable contact 4. At this blind cavity, said conductive body is fitted with contact rings to provide a sliding electrical connection with the movable contact 4, when this latter is inserted in said blind cavity. Said conductive body is conveniently fixed to a suitable conductive support.

Preferably, as shown in FIG. 1, each electric pole 2 comprises actuation means 91 (e.g. an electric motor and mechanical connection means 92 (e.g. a kinematic chain including the actuating rod 9) to actuate the movable contacts 4 during a switching manoeuvre of the switching device 1.

According to alternative embodiments, however, the switching device 1 may be equipped with centralized actuation means adapted to actuate the movable contacts 4 of all the electric poles 2 installed in the switching device.

Preferably, the switching device 1 comprises control means 96 (e.g. including one or more microprocessors) for controlling operation of the actuation means 91 and, possibly, additional functionalities of the switching device 1.

According to the invention, each electric pole 2 comprises a stack 6 of semiconductor devices including a plurality of solid-state semiconductor devices 60 and first and second stack terminals 61, 62 electrically connected with said semiconductor devices (FIG. 9).

The semiconductor devices 60 are adapted to switch in an ON state (conduction state) or in an OFF state (interdiction state) depending on the voltage provided thereon.

Preferably, the semiconductor devices 60 are configured to operate as electric diodes.

Thus, when they switch in an ON state, the semiconductor devices 60 allow the flow of a current according to a predefined conduction direction, whereas, when they switch in an OFF state, the semiconductor devices 60 block the flow of a current passing there through.

The semiconductor devices 60 may be, as non-limiting examples, power diodes (as shown in the cited figures).

The semiconductor devices 60 are piled one on another to form a stack structure and are electrically connected in series one to another to form a chain of semiconductor devices.

The stack 60 of semiconductor devices is thus adapted to allow a current to flow according to a predefined conduction direction CD, when the semiconductor devices thereof are in an ON state (FIGS. 2-4, 9).

In one or more electric poles (as shown in the cited figures) of the switching device 1, the stack 6 of semiconductor devices may comprise:

- an initial semiconductor device 60 having an anode terminal electrically and mechanically coupled with the first stack terminal 61 and having a cathode terminal electrically and mechanically coupled with the anode terminal of an adjacent semiconductor device;
- a final semiconductor device 60 having an anode terminal electrically and mechanically coupled with the cathode terminal of an adjacent semiconductor device and a cathode terminal electrically and mechanically coupled with the second stack terminal 62;
- possible one or more intermediate semiconductor devices 60, each intermediate semiconductor device having an anode terminal electrically and mechanically coupled with a cathode terminal of an adjacent semiconductor device and having a cathode terminal electrically and mechanically coupled with an anode terminal of a further adjacent semiconductor device.

However, the stack of semiconductor devices may be arranged with a dual configuration with respect to the configuration shown in the cited figures.

In one or more electric poles (not shown in the cited figures) of the switching device 1, the stack 6 of semiconductor devices may thus comprise:

- an initial semiconductor device having an anode terminal electrically and mechanically coupled with the second stack terminal 62 and having a cathode terminal electrically and mechanically coupled with the anode terminal of an adjacent semiconductor device;
- a final semiconductor device having an anode terminal electrically and mechanically coupled with the cathode terminal of an adjacent semiconductor device and a cathode terminal electrically and mechanically coupled with the first stack terminal 61;

possible one or more intermediate semiconductor devices, each intermediate semiconductor device having an anode terminal electrically and mechanically coupled with a cathode terminal of an adjacent semiconductor device and having a cathode terminal electrically and mechanically coupled with an anode terminal of a further adjacent semiconductor device.

The above-described arrangements of the stack 6 of semiconductor devices may be properly chosen depending on the behaviour of the electric phases of the switch device 1.

Figure 12:
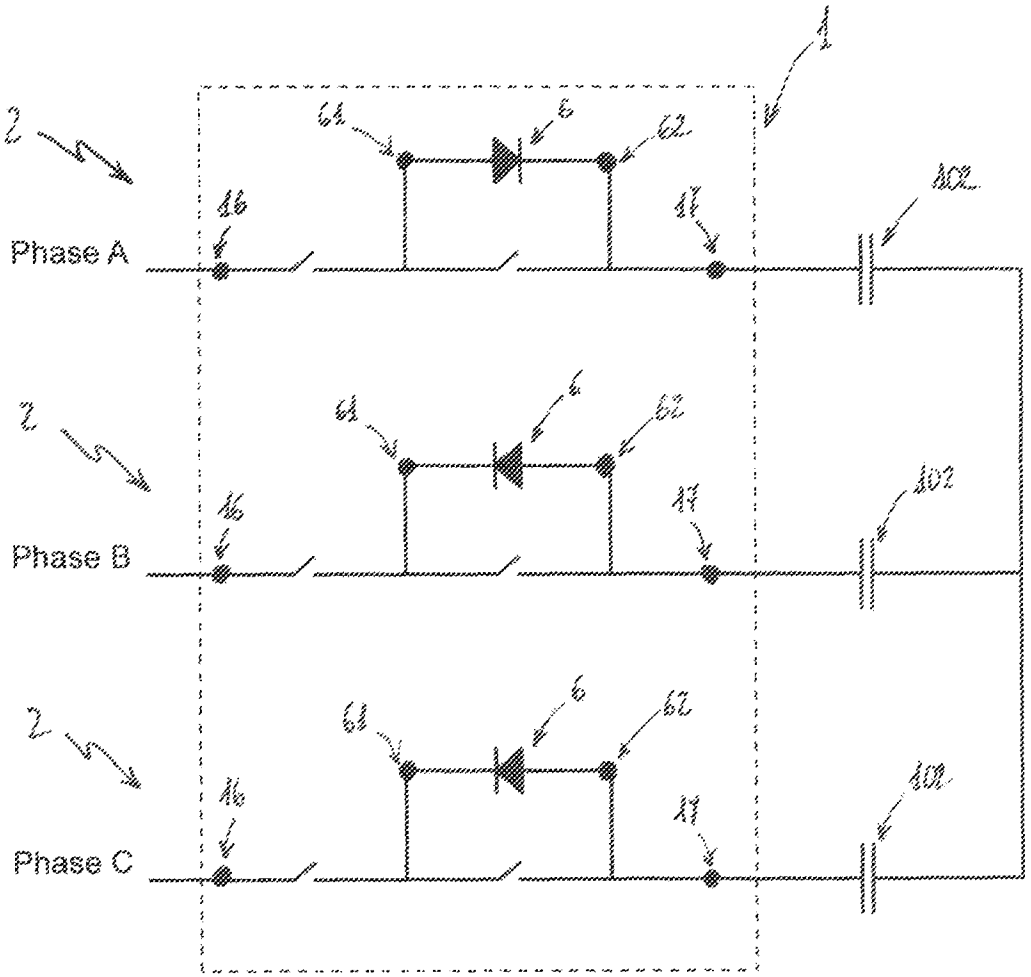

FIG. 12 shows an example of switching device 1, according to the invention, having three electric poles 2 feeding capacitive loads 102. As it is possible to notice, in the electric pole 2 corresponding to the electric phase A, the stack 6 of semiconductor devices is arranged with the configuration shown in the cited figures. Instead, in the electric poles 2 corresponding to the electric phases B and C, the stack 6 of semiconductor devices is arranged with a dual configuration with respect to the one shown in the cited figures. Other arrangements may be suitably designed by the skilled person, according to the needs.

Preferably, as shown in the cited figures, the stack 6 of semiconductor devices comprises a plurality of intermediate semiconductor devices 60.

Preferably, the stack 60 of semiconductor devices comprises connection means 64 to mechanically couple adjacent semiconductor devices 60 and to mechanically couple said first and second stack terminals 61, 62 with a corresponding semiconductor device 60.

Preferably, the connection means 64 comprise a plurality of pins (which may be made in a conductive or plastic material), each of which is adapted to be removably inserted in suitable seats obtained at the anode and cathode terminals of adjacent semiconductor devices 60 and at the first and second stack terminals 61, 62.

According to the invention, the first stack terminal 61 is electrically connected to the fixed contact 5 while the first and second stack terminals 61, 62 are electrically coupleable or decoupleable with or from the movable contact 4 when this latter reaches different positions $P_1$, $P_2$, $P_3$ during a movement towards or away from said fixed contact 5, i.e. during a closing or opening manoeuvre of the switching device 1 (FIGS. 2-4, 9).

Preferably, during the movement towards or away from the fixed contact 5, the movable contact 4 can reach:

a first position $P_1$, in which it is electrically coupled with the fixed contact 5 and with the first and second stack terminals 61, 62 (FIG. 2);

a second position $P_2$, in which it is electrically decoupled from the fixed contact 5 and the first stack terminal 61 and is electrically coupled with the second stack terminal 62 (FIG. 3);

a third position $P_3$, in which it is electrically decoupled from the fixed contact 5 and from the first and second stack terminals 61, 62 (FIG. 4).

In general terms, as the first and second stack terminals 61, 62 are electrically coupleable or decoupleable with or from the movable contact 4 at different given positions of this latter, the semiconductor devices 60 switch in an ON state or in an OFF state at different instants during the movement of the movable contact 4, depending on the position reached by the movable contact itself with respect to the terminals 61, 62.

The stack 6 of semiconductor devices is configured to form an auxiliary conduction path 400 between the pole terminals 16, 17 as the first stack terminal 61 is electrically connected with the fixed contact 5 (and therefore with the first pole terminal 16) and the terminals 61, 62 are electrically coupleable or decoupleable with or from the movable contact 4 (and therefore with the second pole terminal 17).

Depending on the position of the movable contact 4 with respect to the terminals 61, 62, the auxiliary conduction path 400 may be interrupted or short-circuited.

The operation of the stack 6 of semiconductor devices in relation to the position of the movable contact 4 is now described with reference to the arrangement shown in the cited figures.

Obviously, the stack 6 of semiconductor devices will operate in a similar way also when it is arranged with a dual configuration with respect to the configuration shown in the cited figures.

When the movable contact 4 is in or reaches the first position $P_1$ (FIG. 2), the semiconductor devices 60 are or switch in an OFF state, as the first and second stack terminals 61, 62 are short-circuited (FIG. 9). In this case, the auxiliary conduction path 400 is short-circuited and no currents pass through the semiconductor devices 60 (apart from possible negligible parasitic leakages). The main conduction path 300 instead ensures an electrical continuity between the pole terminals 16, 17 as the fixed contact 5 and the movable contact 4 are electrically coupled. A load current $I_{LOAD}$ passes through the main conduction path 300.

When the movable contact 4 reaches the second position $P_2$ (FIG. 3), the semiconductor devices 60 switch in an ON state, when a positive voltage higher than a given threshold voltage value is provided between the first and second stack terminals 61, 62 (FIG. 9).

Such a voltage threshold value (e.g. of few volts) depends on the physical characteristics of the semiconductor devices 60 and is typically very smaller than the peak value of the voltage of the electric phase conductor 101A.

A load current $I_{LOAD}$ passes through the auxiliary conduction path 400, which, in this case, comprises the first stack terminal 61, the semiconductor devices 60 and the second stack terminal 62.

When the movable contact 4 is in or reaches the third position $P_3$ (FIG. 4), the semiconductor devices 60 switch in an OFF state as the first and second stack terminals 61, 62 are electrically decoupled from the movable contact 4. Therefore, no currents pass through the auxiliary conduction path 400. In addition, the main conduction path 300 is interrupted, as the fixed contact 5 and the movable contact 4 are electrically decoupled (FIG. 9).

Figure 10:
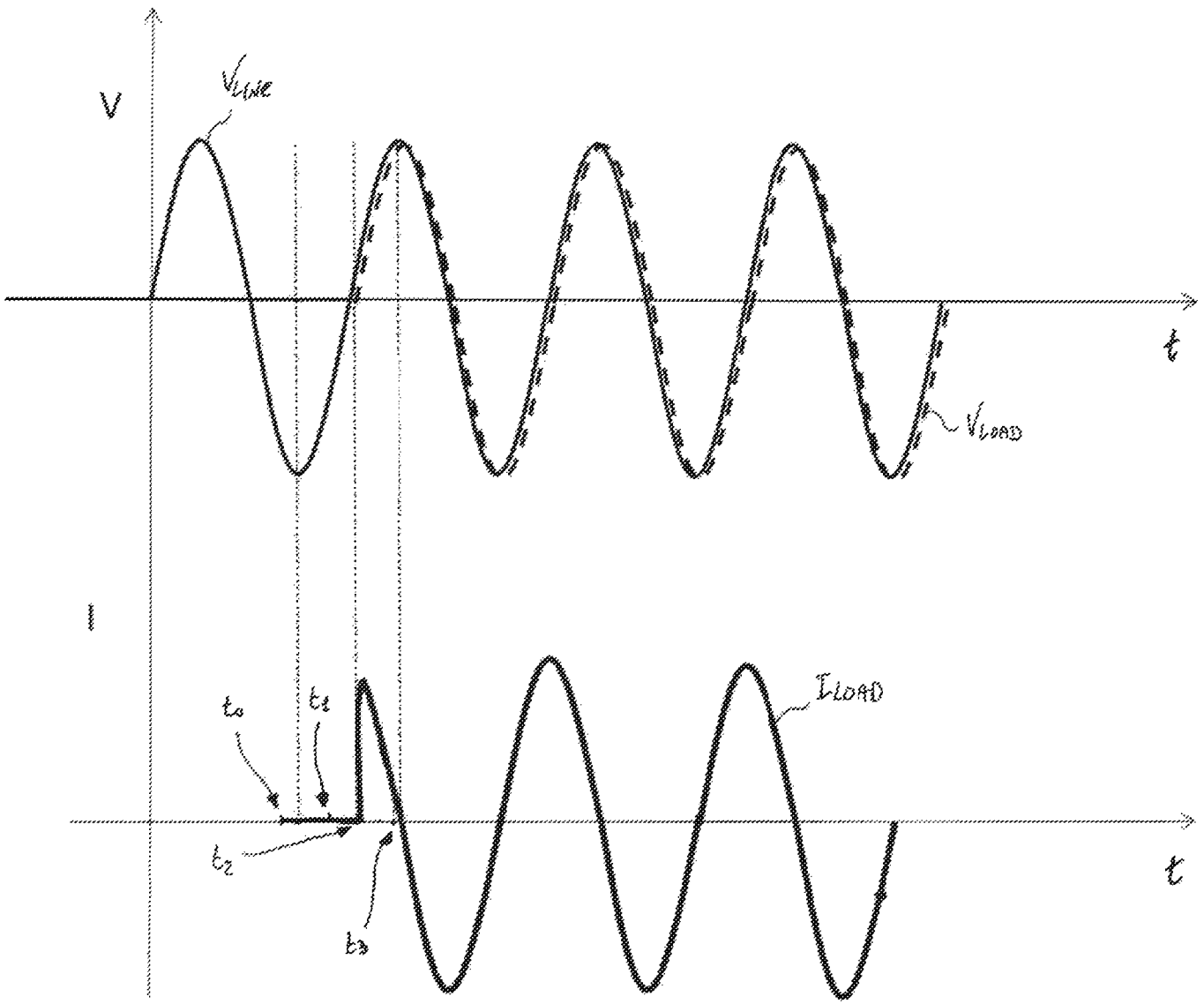

FIG. 10 schematically shows an exemplary behaviour of some relevant electrical quantities such as the line voltage $V_{LINE}$ of the electric power source 101, the load voltage $V_{LOAD}$ provided to the electric load 102 (which is supposed to be of capacitive type) and the load current $I_{LOAD}$ passing through the electric pole 2 during a closing manoeuvre of the switching device 1 (reference is made to the embodiments shown in the cited figures).

When analysing the behaviour of the aforesaid relevant electrical quantities, the above mentioned threshold voltage value can be approximated at 0V, as it is negligible with respect to the peak value of the line voltage $V_{LINE}$.

At the instant to, the movable contact 4 is supposed to start moving towards the fixed contact 5. In this situation, the movable contact 4 is still electrically decoupled from the first and second stack terminals 61, 62 and from the fixed contact 5 (third position $P_3$). No load current $I_{LOAD}$ flows towards the electric load 102 as the main conduction path 300 and the auxiliary conduction path 400 are still interrupted.

At the instant $t_1$, the movable contact 4 is supposed to reach the second position $P_2$, thereby being electrically coupled with the second stack terminal 62 and electrically decoupled from the first stack terminals 61 and from the fixed contact 5. Supposing that the load voltage $V_{LOAD}$ is initially at 0V, the line voltage $V_{LINE}$ is provided between the first and second stack terminals 61, 62 of the circuit assembly 6. The semiconductor devices 60 switch in an ON state at the instant $t_2$ as soon as the line voltage $V_{LINE}$ becomes positive (zero crossing).

At the instant $t_2$, the load current $I_{LOAD}$ starts passing through the auxiliary conduction path 400, which ensures an electrical continuity between the pole terminals 16, 17 and the load voltage $V_{LOAD}$ starts following the line voltage $V_{LINE}$ (apart from a small resistive voltage drop offered by the semiconductor devices 60 in an ON state).

At the instant $t_3$, the movable contact 4 is supposed to reach the first position $P_1$, thereby being electrically coupled with the first and second stack terminals 61, 62 and with the fixed contact 5. The semiconductor devices 60 switches in an OFF state, as the input and output 61, 62 are short-circuited. The auxiliary conduction path 400 is short-circuited and the load current $I_{LOAD}$ passes through the main conduction path 300 as the movable and fixed contacts 4, 5 are electrically coupled. The main conduction path 300 ensures an electrical continuity between the pole terminals 16, 17 and the load voltage $V_{LOAD}$ follows the line voltage $V_{LINE}$.

In relation to the above illustrated example, it is evident that the behaviour of the above electrical quantities (in particular of the load current $I_{LOAD}$) can vary depending of the timing of the instants $t_1$, $t_2$, $t_3$, which in turn depends on the initial instant of the closing manoeuvre, the motion law followed by the movable contact 4 and the relative positions among the terminals 61, 62 and the fixed contact 5.

However, the above illustrated example shows how the semiconductor devices 60 switch in an ON state or in an OFF state at different instants $t_2$, $t_3$ during the movement of the movable contact 4 depending on the position reached by this latter during the closing manoeuvre of the switching device 1.

Obviously, the above-mentioned electrical quantities in the electric pole 2 will behave in a similar manner when the stack 6 of semiconductor devices is arranged with a dual configuration with respect to the configuration shown in the cited figures.

Figure 11:
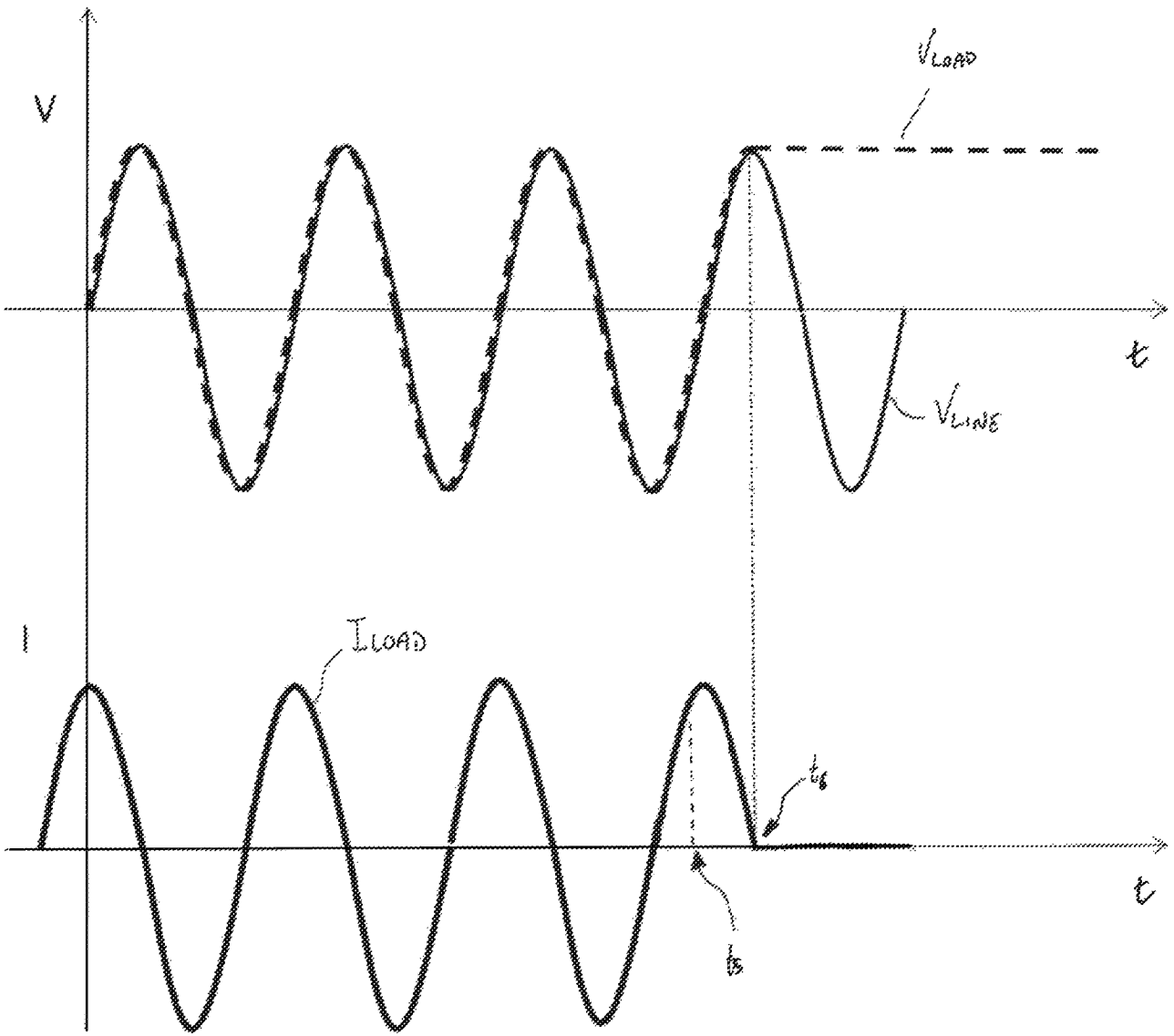

FIG. 11 schematically shows an exemplary behaviour of the electrical quantities $V_{LINE}$, $V_{LOAD}$ and $I_{LOAD}$ in the electric pole 2 during an opening manoeuvre of the switching device 1 (reference is made to the embodiments shown in the cited figures).

Again, the above-mentioned threshold voltage value is approximated at 0V, as they are negligible with respect to the peak value of the line voltage $V_{LINE}$.

Before the movable contact 4 starts moving away from the fixed contact 5, the movable contact is electrically coupled with the input and output and intermediate terminals 61, 62 and with the fixed contact 5 (first position $P_1$). In this situation, the semiconductor devices 60 are in an OFF state and the auxiliary conduction path 400 is short-circuited. The load current $I_{LOAD}$ passes through the main conduction path 300 as the movable and fixed contacts 4, 5 are electrically coupled. The main conduction path 300 ensures an electrical continuity between the pole terminals 16, 17 and the load voltage $V_{LOAD}$ follows the behaviour of the line voltage $V_{LINE}$. At the instant $t_5$, the movable contact 4 is supposed to reach the second position $P_2$, thereby being electrically coupled with the second stack terminal 62 and being electrically decoupled from the first stack terminal 61 and from the fixed contact 5. The separation between the movable contact 4 and the fixed contact 5 forces the load current $I_{LOAD}$ to pass through the semiconductor devices 60. The semiconductor devices 60 switch in an ON state, as a positive voltage (basically due to the resistive voltage drop offered by the semiconductor devices 60) is provided between the first and second stack terminals 61, 62 that are no more short-circuited. The load current $I_{LOAD}$ starts passing through the auxiliary conduction path 400, which ensures an electrical continuity between the pole terminals 16, 17 and the load voltage $V_{LOAD}$ follows the line voltage $V_{LINE}$ (apart from a small resistive voltage drop due to the semiconductor devices 60 in an ON state).

At the instant $t_6$, the semiconductor devices 60 switch in an OFF state as a negative voltage is provided between the first and second stack terminals 61, 62. No load current $I_{LOAD}$ flows towards the electric load 102 as the main conduction path 300 and the auxiliary conduction path 400 are interrupted (FIG. 9).

The load voltage $V_{LOAD}$ does not follow the line voltage $V_{LINE}$ anymore (it remains initially constant at the peak value of the voltage $V_{LINE}$ as the electric load 102 is supposed to be of capacitive type).

The movable contact 4 can reach the third position $P_3$, at which it is electrically decoupled from the first and second stack terminals 61, 62 and from the fixed contact 5.

In relation to the above illustrated example, it is evident that the behaviour of the above electrical quantities (in particular of the load current $I_{LOAD}$) can vary depending of the timing of the instants $t_5$, $t_6$, which in turn depends on the initial instant of the opening manoeuvre, the motion law followed by the movable contact 4 and the relative positions among the terminals 61, 62 and the fixed contact 5.

However, the above illustrated example shows how the semiconductor devices 60 switch at different instants $t_5$, $t_6$ during the movement of the movable contact 4 depending on the position reached by this latter during the opening manoeuvre of the switching device 1.

Obviously, the above-mentioned electrical quantities in the electric pole 2 will behave in a similar manner when the stack 6 of semiconductor devices is arranged with a dual configuration with respect to the configuration shown in the cited figures.

In general, as for the above-mentioned solutions of the state of the art (e.g. the one proposed in EP2523203), the arrangement of a plurality of semiconductor devices 60, which are electrically coupleable or decoupleable with the movable contact 4 to establish or interrupt an auxiliary conduction path 400 between the pole terminals 16, 17 in parallel with the main conduction path 300, provides relevant advantages in terms of reduction of parasitic phenomena, such as the generation of electrical arcs during opening manoeuvres (when the electric power source 101 is disconnected from the electric load 102) and, on the other hand, limits possible inrush currents and transient over-voltages generated during closing manoeuvres (when the electric power source 101 electrically couples with the electric load 102).

An important aspect of the invention is however represented by the arrangement of the semiconductor devices 60 in a compact stack structure.

As a matter of fact, this solution provides relevant advantages in terms of reduction of the volume occupied by said semiconductor devices. Semiconductor devices 60 are piled in a compact structure that can be accommodated in a suitable portion of the internal volume 20.

According to an additional important aspect of the invention, the semiconductor devices 60 and the said fixed contact 5 are arranged at the top end 32 of the insulating housing 3, respectively in a proximal position and in a distal position relative to the top end 32.

Thanks to such a relative positioning with respect to the fixed contact 5, the semiconductor devices can be suitably arranged at a dedicated portion of the internal volume 20 of the electric pole 2 at the top end 32 of the housing 3.

This solution allows simplifying the layout of the internal components of the electric pole 2 with respect to traditional solutions of the state of the art.

As a consequence, more space can be reserved to the semiconductor devices 60 and a smaller number of semiconductor devices 60 (e.g. power diodes), which have a larger size and capable of withstanding higher operating voltages and currents with respect to traditional solutions of the state of the art, may be employed.

The adoption of a smaller number of semiconductor devices 60 allows reducing the overall forward voltage drop across said semiconductor devices and consequently power losses.

On the other hand, the adoption of semiconductor devices 60 with a larger size allows improving the overall current switching capabilities offer by the switching device 1. The switching device 1 can operate at higher current levels, e.g. up to 50 kA, thereby being able to withstand particularly strong in-rush currents or even being able to interrupt short-circuit currents.

Thanks to the obtaining of an optimized layout of the internal components within the electric pole 2, suitable dielectric distances can be easily maintained between live components, which decrease the probability of faults. Additionally, live components (e.g. the movable contact 4, the fixed contact 5, the pole terminals 16, 17) can have increased dimensions, which helps withstanding high current levels.

According to an embodiment of the invention, each electric pole 2 comprises a first component assembly adapted to mechanically support the semiconductor devices 60 and the fixed contact 5 and adapted to electrically connect the semiconductor devices 60 with the fixed contact 5 and, possibly, with the movable contact 4 (depending on the operating portion of this latter).

Preferably, such a first component assembly comprises a first conductive element 71 forming the first stack terminal 61 of the stack 6 of semiconductor devices.

Preferably, the first conductive element 71 comprises a first portion 711 having opposite first and second supporting surfaces 711A, 711B respectively in a proximal position and in a distal position relative to the top end 32 of the insulating housing 3.

The first portion 711 of the first conductive element 71 mechanically supports and electrically connects the semiconductor devices 60 and the fixed contact 5 and it may be conveniently formed by a flat plate lying perpendicular to the longitudinal axis 100 of the electric pole 2 and having the supporting surfaces 711A, 711B at opposite sides.

Preferably, the semiconductor devices 60 and the fixed contact 5 are coaxially arranged at opposite sides of the first portion 711 along or in parallel with the longitudinal axis 100). In particular, the semiconductor devices 60 are mounted on the first supporting surface 711A whereas the fixed contact 5 is mounted on the second supporting surface 711B.

Preferably, the first conductive element 71 comprises a second portion 712 fixed with the first pole terminal 16 and mechanically supporting the semiconductor devices 60 and the fixed contact 5 and to electrically connecting these latter with the first pole terminal 16.

The second portion 712 of the first conductive element 71 may be conveniently formed by a contoured curved plate protruding perpendicularly with respect to the flat wall 711 at an edge section of this latter, preferably in direction of the top end 32 of the insulating housing 3, and mechanically coupled (in a known manner) or made integral with pole terminal 16.

Preferably, the first conductive element 71 is formed by contoured L-shaped cradle, as shown in FIGS. 5-8.

Preferably, such a first component assembly comprises a second conductive element 72 forming the second stack terminal 62 of the stack 6 of semiconductor devices.

The second conductive element 72 mechanically supports the semiconductor devices 60 and provides an electrical connection of these latter with the movable contact 4.

Conveniently, the second conductive element 72 is mounted on the piled semiconductor devices 60 in such a way to sandwich these latter in cooperation with the first conductive element 71. In practice, the first and second conductive elements 71, 72 are arranged at opposite ends of the stack 6 of semiconductor devices (conveniently along or in parallel with the longitudinal axis 100).

The second conductive element 72 may be conveniently formed by a flat plate lying perpendicular to the longitudinal axis 100 of the electric pole 2.

Preferably, such a first component assembly comprises one or more first insulating elements 75 mechanically coupled with the first and second conductive elements 71, 72 at the side of the first supporting surface 711A of the first conductive element (in other words at the side of the first conductive element 71 faced towards the top end 32 of the housing 3).

The first insulating elements 75 allow the first and second conductive elements 71, 72 to exert a retaining force of the semiconductor devices 60 to maintain these latter in a piled position (conveniently in cooperation with the connection means 64).

The first insulating elements 75 may be formed by a plurality of insulating rods extending parallel to the longitudinal axis 100 along a perimeter surrounding the semiconductor devices 60 and fixed in a known manner with the conductive plates 71, 72.

Preferably, such a first component assembly comprises a third conductive component 73 and electric connection means 74 to electrically connect the second and third conductive elements 72, 73.

The third conductive component 73 and the electric connection means 74 provide an electrical connection of the semiconductor devices 60 with the movable contact 4 in cooperation with the second conductive component 72 forming the second stack terminal 62 of the stack 6 of semiconductor devices.

Preferably, the third conductive component 73 has a through hole, through which the movable contact 4 can pass during a switching operation of the switching device. At the edge of said through hole, the third conductive component 73 is conveniently fitted with a contact ring to provide a sliding electrical connection with the movable contact 4, when this latter passes through the through hole.

The third conductive element 73 may be conveniently formed by a holed cup-shaped plate lying perpendicular to the longitudinal axis 100 of the electric pole 2.

Preferably, the electric connection means 74 include a conductive wire or strip having opposite ends fixed in a known manner with the first and second conductive elements 72-73.

Preferably, such a first component assembly comprises at least an second insulating element 76 mechanically coupled with the first and third conductive elements 71, 73 at the side of the second supporting surface 711B of the first portion 711 of the first conductive element 71.

Conveniently, the second insulating element 76 is fixed on the first portion 711 of the first conductive element 71 at the second supporting surface 711B and the third conductive element 73 is fixed on the second insulating element 76 at a distal end of this latter with respect to the first conductive element 71.

The second insulating element 76 may be conveniently formed by a flange-like body provided with a central hole to accommodate the fixed contact 5 and allow the passage of the movable contact 4 therethrough.

FIGS. 7-8 show an embodiment of the invention, in which the electric connection means 74 include a conductive element 77 (conveniently having a bell-shape), which is electrically and mechanically coupled with the second and third conductive elements 72, 73 and it is conveniently arranged to surround at least partially the fixed contact 5 and the semiconductor devices 60.

The conducting element 77 has basically the same function of the above-mentioned conductive wire or strip but it allows obtaining a more uniform distribution of the electric fields surrounding the components of the electric pole 2.

The third insulating element 76 may be conveniently formed by a half-bell like body having its larger portion facing towards the bottom end 31 of the housing 3.

Preferably, each electric pole 2 comprises a second component assembly adapted to electrically connect the movable contact 4 with the second pole terminal 17.

Preferably, such a second component assembly comprises a fourth conductive component 78 fixed to the second pole terminal 17 and having a through hole, through which the movable contact 4 can pass during a switching operation of the switching device. At the edge of said through hole, the fourth conductive component 78 is conveniently fitted with a contact ring to provide a sliding electrical connection with the movable contact 4, when this latter passes through the through hole.

The switching device 1, according to the invention, offers remarkable advantages.

The switching device 1 shows an excellent switching efficiency and provides excellent performances in terms of reduction of parasitic phenomena during the opening/closing manoeuvres.

The switching device 1 is capable of operating even at high current levels, thereby showing improved switching performances with respect to the available switching devices of the state of the art. Differently from traditional switching devices, the switching device 1 can operate even when short-circuit currents are present. The switching device 1 can thus be used as a circuit breaker or disconnector capable of intervening even when short-circuits events affect the electric power source 101 or the electric load 102.

The switching device 1 comprises electric poles with a simplified and optimized layout of the internal components, which allows limiting overall size and reducing manufacturing costs. The switching device 1 is thus particularly simple and cheap to manufacture at industrial level.

The switching device 1 has a simple and robust structure, which is particularly adapted to be integrated in a LV or MV switchgear.

The invention claimed is:

1. A switching device for low or medium voltage electric power distribution networks, said switching device comprising one or more electric poles, each electric pole comprising:

an insulating housing extending along a longitudinal axis and having, along said longitudinal axis, a bottom end, at which said housing is fixed to a main support structure of said switching device, and a top end opposite to said bottom end;

a first pole terminal and a second pole terminal electrically connectable with a corresponding phase conductor of an electric power source and with a corresponding load conductor of an electric load, respectively;

a movable contact and a fixed contact, which are coupleable or decoupleable one with or from another, said fixed contact being electrically connected with said first pole terminal, said movable contact being electrically connectable with said second pole terminal;

a stack of semiconductor devices adapted to switch in a conduction state or in an interdiction state depending on the voltage provided thereto, said semiconductor devices being electrically connected in series one to another in such a way that a current can flow according to a predefined conduction direction when said semiconductor devices are in a conduction state, said stack of semiconductor devices including first and second stack terminals electrically connected with said semiconductor devices, said first stack terminal being electrically connected with said fixed contact, said first and second stack terminals being electrically coupleable with or decoupleable from said movable contact when said movable contact reaches different positions during a movement towards or away from said fixed contact, said semiconductor devices and said fixed contact being arranged at the top end of said insulating housing, respectively in a proximal position and in a distal position relative to the top end of said insulating housing.

2. The switching device, according to claim 1, wherein each electric pole comprises a first component assembly adapted to mechanically support said semiconductor devices and said fixed contact and adapted to electrically connect said semiconductor devices with said fixed contact and, possibly, with said movable contact.

3. The switching device, according to claim 2, wherein said first component assembly comprises:

a first conductive element forming said first stack terminal and comprising a first portion having opposite first and second supporting surfaces respectively in a proximal position and in a distal position relative to the top end of said insulating housing, said semiconductor devices being mounted on said first supporting surface, said fixed contact being mounted on said second supporting surface;

a second conductive element forming said second stack terminal and mounted on said semiconductor devices so that said semiconductor devices are sandwiched between said first and second conductive elements;

a third conductive element providing a sliding electric contact with said movable contact;

electric connection means to electrically connect said second and third conductive elements.

4. The switching device, according to claim 3, wherein said first component assembly comprises first insulating elements mechanically coupled with said first and second conductive elements at the side of said first supporting surface.

5. The switching device, according to claim 3, wherein said first component assembly comprises a second insulating element mechanically coupled with said first and third conductive elements at the side of said second supporting surface.

6. The switching device, according to claim 3, wherein said first conductive element comprises a second portion mechanically supporting said fixed contact and said semiconductor devices and electrically connecting said fixed contact and said semiconductor devices with said second pole terminal.

7. The switching device, according to claim 1, wherein each electric pole comprises a second component assembly adapted to electrically connect said movable contact with said second pole terminal.

8. The switching device, according to claim 1, wherein during a movement towards or away from said fixed contact, said movable contact reaches:

a first position, in which said movable contact is electrically coupled with said fixed contact and with said first and second stack terminals;

a second position, in which said movable contact is electrically decoupled from said fixed contact and from said first stack terminal and is electrically coupled with said second stack terminals;

a third position, in which said movable contact is electrically decoupled from said fixed contact and from said first and second stack terminals.

9. The switching device, according to claim 1, wherein during a movement of said movable contact away from said fixed contact:

said semiconductor devices are in an interdiction state, when said movable contact is said first position;

said semiconductor devices switch in a conduction state, when said movable contact reaches said second position;

said semiconductor devices switch in an interdiction state, when said movable contact reaches said third position.

10. The switching device, according to claim 1, wherein during a movement of said movable contact towards said fixed contact:

said semiconductor devices are in an interdiction state, when said movable contact is said third position;

said semiconductor devices switch in a conduction state, when said movable contact reaches said second position;

said semiconductor devices switch in an interdiction state, when said movable contact reaches said first position.

11. A switchgear comprising a switching device, according to claim 1.

12. The switching device, according to claim 4, wherein said first component assembly comprises a second insulating element mechanically coupled with said first and third conductive elements at the side of said second supporting surface.

13. The switching device, according to claim 12, wherein said first conductive element comprises a second portion mechanically supporting said fixed contact and said semiconductor devices and electrically connecting said fixed contact and said semiconductor devices with said second pole terminal.

14. The switching device, according to claim 4, wherein said first conductive element comprises a second portion mechanically supporting said fixed contact and said semiconductor devices and electrically connecting said fixed contact and said semiconductor devices with said second pole terminal.

15. The switching device, according to claim 5, wherein said first conductive element comprises a second portion mechanically supporting said fixed contact and said semiconductor devices and electrically connecting said fixed contact and said semiconductor devices with said second pole terminal.

16. The switching device, according to claim 2, wherein each electric pole comprises a second component assembly adapted to electrically connect said movable contact with said second pole terminal.

17. The switching device, according to claim 3, wherein each electric pole comprises a second component assembly adapted to electrically connect said movable contact with said second pole terminal.

18. The switching device, according to claim 4, wherein each electric pole comprises a second component assembly adapted to electrically connect said movable contact with said second pole terminal.

19. The switching device, according to claim 5, wherein each electric pole comprises a second component assembly adapted to electrically connect said movable contact with said second pole terminal.

20. The switching device, according to claim 6, wherein each electric pole comprises a second component assembly adapted to electrically connect said movable contact with said second pole terminal.

* * * * *